US008277344B2

(12) United States Patent
Cea et al.

(10) Patent No.: US 8,277,344 B2
(45) Date of Patent: Oct. 2, 2012

(54) LIGHTED GAMING BAG

(75) Inventors: Todd A. Cea, Cuyahoga Falls, OH (US); Russell A. Urban, Elyria, OH (US); Ronald E. Kovac, Stow, OH (US)

(73) Assignee: Maxroi, LLC, Stow, OH (US)

( * ) Notice: Subject to any disclaimer, the term of this patent is extended or adjusted under 35 U.S.C. 154(b) by 537 days.

(21) Appl. No.: 12/485,493

(22) Filed: Jun. 16, 2009

(65) Prior Publication Data

US 2010/0317470 A1 Dec. 16, 2010

(51) Int. Cl.
*A63B 65/00* (2006.01)

(52) U.S. Cl. ..... 473/570; 473/594

(58) Field of Classification Search ..... 473/570, 473/571, 577, 594; 446/46, 47; 273/DIG. 24
See application file for complete search history.

(56) References Cited

U.S. PATENT DOCUMENTS

| | | | | | |
|---|---|---|---|---|---|
| 3,480,280 | A | * | 11/1969 | Gamertsfelder | 473/594 |
| 3,937,470 | A | * | 2/1976 | Stalberger et al. | 473/594 |
| 4,354,679 | A | * | 10/1982 | Steinmetz | 473/594 |
| 4,479,649 | A | * | 10/1984 | Newcomb et al. | 473/570 |
| 4,717,158 | A | * | 1/1988 | Pennisi | 473/570 |
| 4,923,201 | A | | 5/1990 | Nichol et al. | |
| 4,927,160 | A | | 5/1990 | Nichol et al. | |
| 4,963,117 | A | * | 10/1990 | Gualdoni | 446/219 |
| 5,639,076 | A | * | 6/1997 | Cmiel et al. | 473/570 |
| 5,779,574 | A | * | 7/1998 | Allman et al. | 473/570 |
| 5,807,197 | A | * | 9/1998 | Grafton | 473/594 |
| 5,830,034 | A | * | 11/1998 | Ciechanowski et al. | 446/219 |
| 5,893,811 | A | * | 4/1999 | Stover et al. | 473/575 |
| 5,910,059 | A | * | 6/1999 | Hanson | 473/594 |
| 5,954,603 | A | * | 9/1999 | Chursinoff | 473/594 |
| 6,059,676 | A | * | 5/2000 | Seymour et al. | 473/570 |
| 6,109,761 | A | | 8/2000 | Smith et al. | |
| 6,431,724 | B1 | * | 8/2002 | Tedham et al. | 362/154 |
| 6,544,093 | B2 | * | 4/2003 | Komuro | 446/47 |
| 6,656,066 | B2 | * | 12/2003 | Barker | 473/570 |
| 2006/0038341 | A1 | | 2/2006 | Konstant | |
| 2009/0312127 | A1 | * | 12/2009 | Kessler | 473/570 |

* cited by examiner

*Primary Examiner* — Steven Wong
(74) *Attorney, Agent, or Firm* — Sand & Sebolt

(57) ABSTRACT

A gaming bag including at least one outer wall defining a cavity, at least one light emitting source positioned adjacent the at least one outer wall, a filling material disposed within the cavity, and wherein the at least one light emitting source provides illumination. A method of lighting a gaming bag comprising the steps of providing a gaming bag comprising at least one outer wall defining a cavity, at least one light emitting source positioned adjacent the at least one wall, a shock sensor within the cavity, a filling material within the cavity, and wherein the at least one light emitting source provides illumination, tossing the gaming bag, measuring a force with the shock sensor upon impact with a surface, activating the light emitting source when the force is greater than the predetermined threshold, and deactivating the light emitting source after a predetermined amount of time.

17 Claims, 8 Drawing Sheets

LIGHTED GAMING BAG

BACKGROUND OF THE INVENTION

1. Technical Field

The invention relates generally to a tossable gaming bag. More particularly, the invention relates to a tossable gaming bag having a filler material such as corn or beans and an illumination source. Specifically, the invention relates to a lighted gaming bag having either an internal or external illumination source as well as the ability to selectively illuminate the respective sources.

2. Background Information

Gaming bags come in a variety of shapes and sizes for a multitude of purposes. Gaming bags may be used in combination with a target or just freely thrown about. One of the more popular games that utilizes gaming bags is cornhole.

Cornhole is generally played with two game boards and eight gaming bags. The gaming bags have two sets of distinctive colors or patterns, with four bags having each color or pattern. The gaming bags are generally made of duck cloth or a similar heavy weight tight woven material to ensure strength and durability for outdoor use. The cornhole board in generally rectangular in shape with a raised back end and a hole located proximate the back end. The cornhole board is arranged similar to a ramp so that the gaming bag can be slid towards the back end and still permit the bag to remain on the board after being thrown. Regulation cornhole boards are approximately two feet wide and four feet long, with the front end resting on the ground and the back end raised approximately twelve inches.

Cornhole is played in frames, where each player rotates throwing his or her gaming bag towards the target. After all eight bags have been thrown, the bags remaining on the cornhole board are scored as one point and any bags traversing the hole are scored as three points. The ultimate goal of the game is to be the first team to reach 21 points. Although this seems like a fairly easy task, since the boards are placed approximately thirty-three feet apart from one another, scoring may be difficult. Further, since the boards are required to be a certain distance apart, the game must be played during daylight hours in order to be able to see the board and calculate the score.

Cornhole board manufacturers have adapted the game to include lights surrounding various features of the board. In particular, cornhole boards are sold that include LEDs or fiber optics which define the outer perimeter of the board as well as the scoring hole. Further, LEDs have been used to illuminate the scoring hole from the bottom side. While the lighted cornhole board provides interesting visual effects and allows the players to see the board at night, the player is still unable to determine if his or her bag has landed on the board or traversed the scoring hole. Thus, the players are still unable to adequately play in the dark, and are unable to receive any form of feedback after throwing the gaming bag.

SUMMARY OF THE INVENTION

The present invention broadly comprises a gaming bag including at least one outer wall defining a cavity, at least one light emitting source positioned adjacent the at least one outer wall, a filling material disposed within the cavity, and wherein the at least one light emitting source provides illumination.

The present invention also broadly comprises a method of lighting a gaming bag comprising the steps of providing a gaming bag comprising at least one outer wall defining a cavity, at least one light emitting source positioned adjacent the at least one wall, a shock sensor within the cavity, a filling material within the cavity, and wherein the at least one light emitting source provides illumination, tossing the gaming bag, measuring a force with the shock sensor upon impact with a surface, activating the light emitting source when the force is greater than the predetermined threshold, and deactivating the light emitting source after a predetermined amount of time.

BRIEF DESCRIPTION OF THE SEVERAL VIEWS OF THE DRAWINGS

A preferred embodiment of the invention, illustrative of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
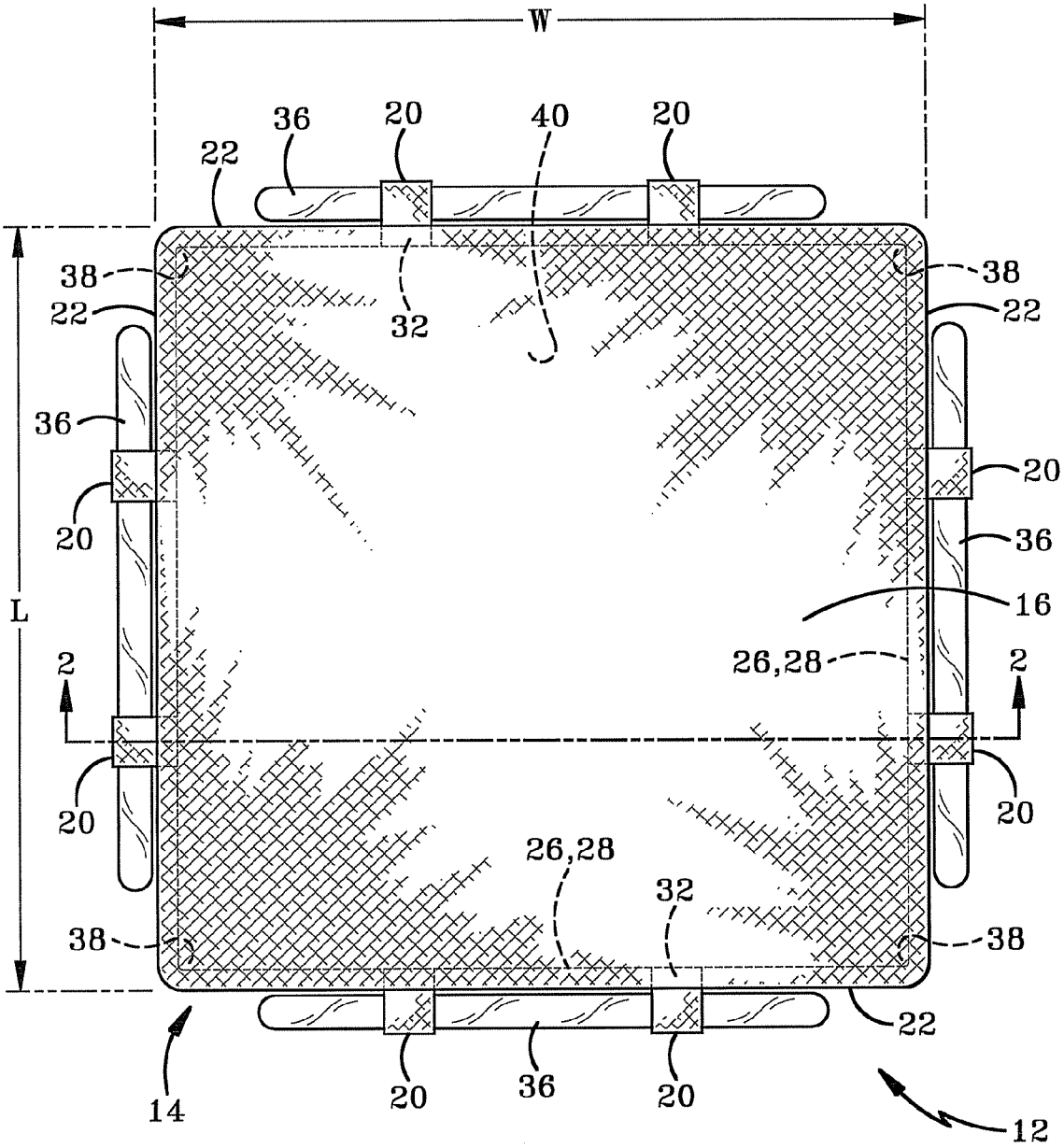
FIG. 1 is a front view of a preferred embodiment gaming bag with glow sticks.

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed aspects.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices and materials are now described.

The lighted gaming bag of the present invention is indicated generally at 12, as is particularly shown in FIGS. 1-11. As particularly shown in FIGS. 1-4, a first preferred embodiment lighted gaming bag 14 includes a top wall 16 and a bottom wall 18. A plurality of mounting loops 20 extend outward from a side wall 22 formed at the attachment of top and bottom walls 16 and 17. Top wall 16 and a bottom wall 18 are secured together with thread 24. As particularly seen in FIG. 3, the top wall includes an end 26, while the bottom wall includes an end 28. The respective ends 26 and 28 are folded inward and stitched shut with thread 24.

Mounting loops 20 are formed from a single cloth layer forming a cavity 30 between a first end 32 and a second end 34. In particular, first and second ends 32 and 34 are located proximate one another and disposed between top wall end 26 and bottom wall end 28 and arranged to provide cavity 30 with approximately the same diameter as the outside diameter of a glow stick 36. As particularly seen in FIGS. 2 and 3, the first and second ends 32 and 34 are secured between top wall end 26 and bottom wall end 28 with thread 24.

In the preferred embodiment, eight mounting loops 20 are arranged in pairs on each side of lighted gaming bag 14. Although gaming bag 14 has been described with eight mounting loops and two mounting loops on each side, one skilled in the art should immediately recognize that any amount of mounting loops and any particular arrangement of mounting loops may be incorporated so long as glow sticks 36 are securely held in place without departing from the spirit and scope of the invention as claimed.

Each side wall 22 of lighted bag 14 is preferably the same length, thereby forming a generally square shape as seen in FIG. 1. Side walls 22 are preferably arranged orthogonal to one another to form a corner 38 at each connection point. Lighted gaming bag 14 preferably has a length L of approximately six inches and a width W of approximately six inches, although any length or width may be utilized. Glow sticks 36, on the other hand, have a length of less than six inches in the preferred embodiment to ensure that the glow stick does not extend beyond each respective side wall 22.

Figure 2:
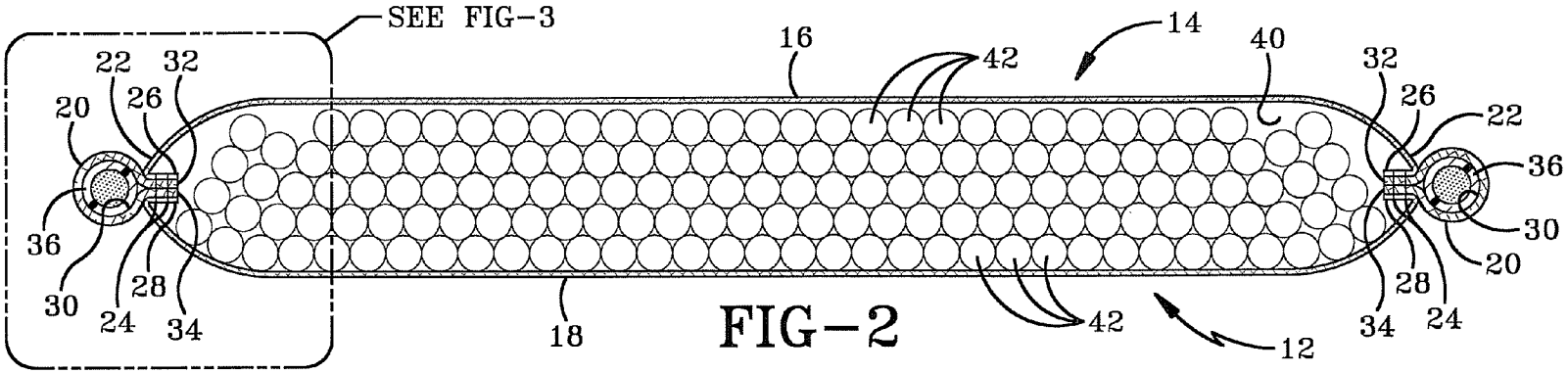
FIG. 2 is a side cross-sectional view of the preferred embodiment gaming bag taken about line 2-2 in FIG. 1.
Figure 3:
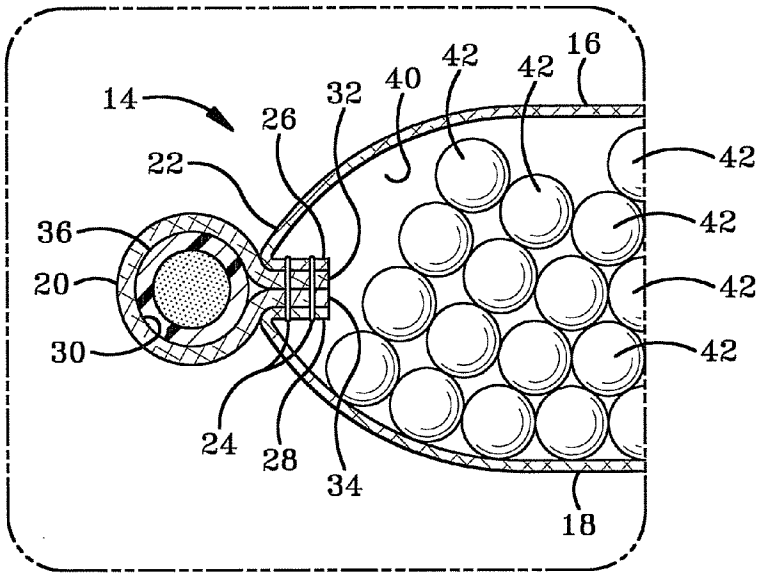
FIG. 3 is an enlarged side view of the section labeled 3-3 in FIG. 2.

Finally, lighted gaming bag 14 includes a cavity 40 formed by top wall 16 and bottom wall 18 and filled with a filling material 42 as seen in FIGS. 2 and 3. Filling material 42 may be any suitable substance including, but not limited to, beans, corn, sand, beads or plastic pellets.

Having described the structure of a first preferred embodiment, a preferred method of operation will now be described in greater detail and should be read in light of FIGS. 1-4 and particularly FIG. 4.

Figure 4:
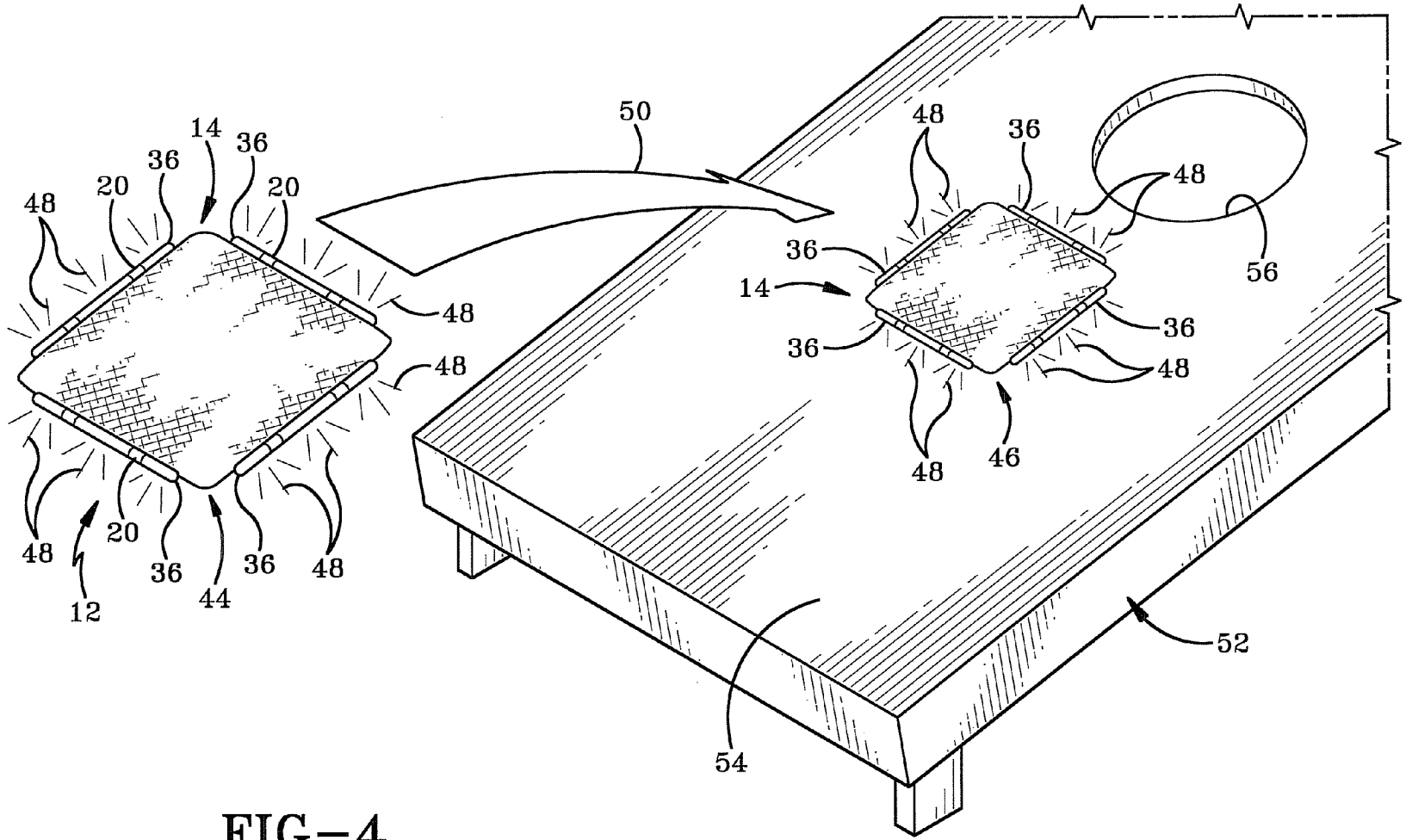
FIG. 4 is a perspective view of the preferred embodiment gaming bag being thrown and landing on a cornhole board.

FIG. 4 illustrates lighted gaming bag 14 in a first position 44 and a second position 46. In order to provide illumination from the glow sticks, the user may either remove glow stick 36 and snap each of them to provide the illumination and then replace the glow stick within mounting loops 20, or the user may snap the glow stick while still within mounting loops 20. After each of glow sticks 36 have been snapped to provide illumination 48, the user can then begin using lighted gaming bag 14. In particular, the user throws lighted gaming bag 14 in the direction associated with arrow 50 in an attempt to locate gaming bag 14 on a gaming board 52 and particularly a top surface 54 or a scoring hole 56. Since lighted gaming bag 14 provides illumination 48 from glow stick 36, the user may play the game in low or no light conditions and still be able to located the gaming bag at all times.

Having described the structure and operation of the first embodiment, only those portions of the second embodiment which are different than the first embodiment are described in greater detail. Likewise, similar numerals refer to similar parts throughout the various embodiments.

A second preferred embodiment lighted gaming bag 58 is illustrated in FIGS. 5-9. Second embodiment gaming bag 58 is similar to the first embodiment gaming bag in that the second embodiment gaming bag includes top wall 16 and bottom wall 18 arranged in a preferably square shape with orthogonal connections between side walls 22. The second embodiment gaming bag may also include mounting loops 20 to secure glow sticks 36.

Figure 5:
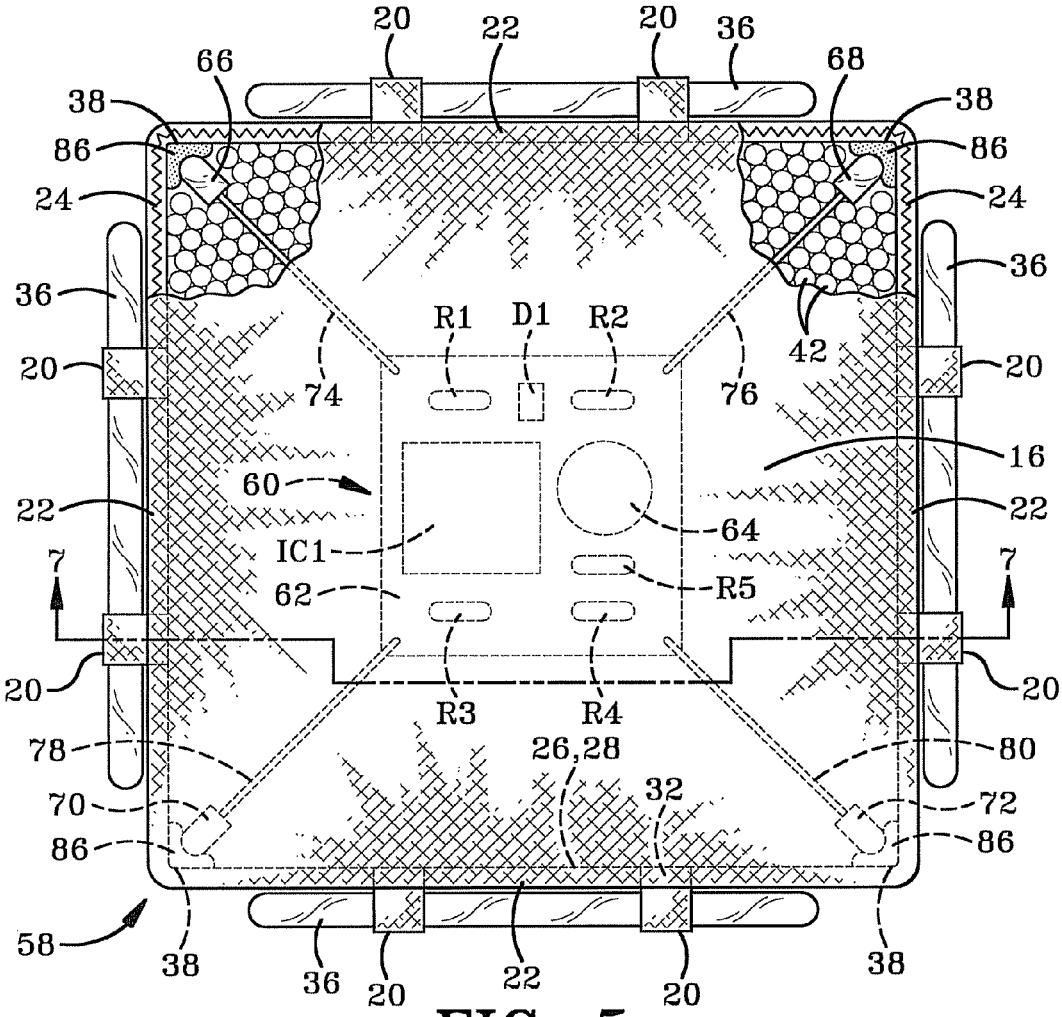
FIG. 5 is a top plan view of a second preferred embodiment gaming bag with glow sticks and an internal light emitting source with portions removed and portions shown in dashed lines.
Figure 6:
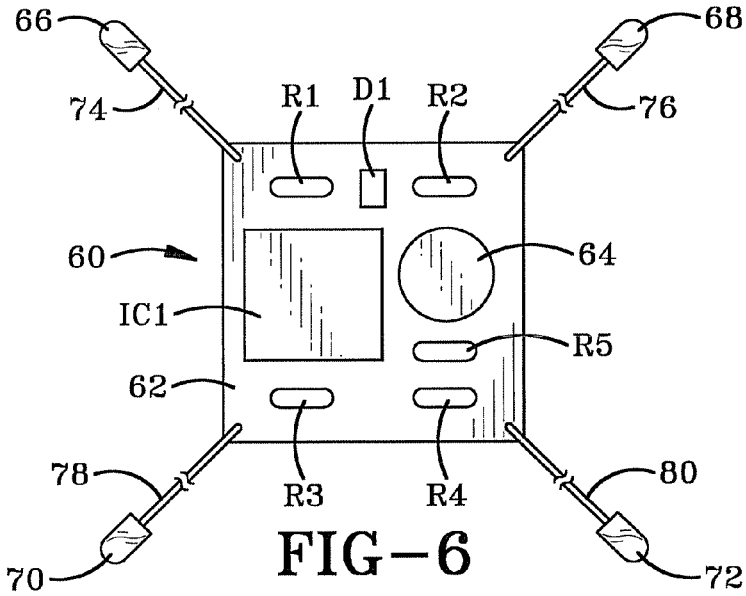
FIG. 6 is a top plan view of a preferred embodiment light emitting source removed from the gaming bag.
Figure 7:
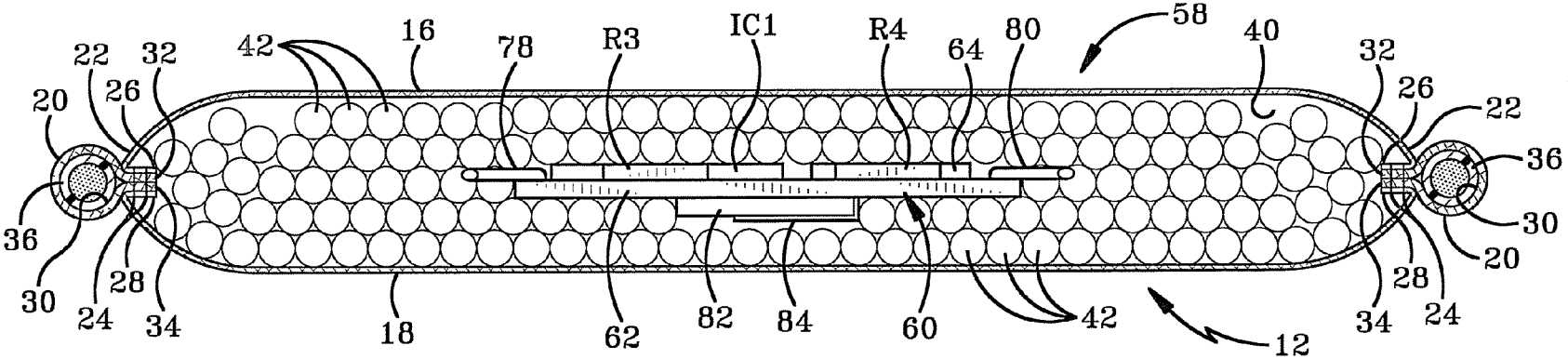
FIG. 7 is a side cross-sectional view of the second preferred embodiment gaming bag taken about line 7-7 in FIG. 5.

In accordance with another main feature of the invention, lighted gaming bag 58 includes a light emitting source 60 as seen in FIGS. 5, 6 and 7. Light emitting source 60 includes a printed circuit board 62 with a controller IC1, a sensor 64, a diode D1 and a plurality of resistors R1 through R5. The light emitting source also includes LEDs 66, 68, 70 and 72. Resistor R1 is in electrical communication with LED 66 through wire 74, while resistor R2 is in electrical communication with LED 68 via wire 76. In the same manner, LED 70 is in electrical communication with resistor R3 via wire 78 and LED 72 is in electrical communication with resistor R4 via wire 80. Light emitting source 60 includes a battery 82 or other sufficient power source, located intermediate terminal 84 and printed circuit board 62 for providing illumination of LEDs 66-72 as seen in FIG. 7. Finally, the printed circuit board, or control panel, may include a device which allows the user to select the sequence of LEDs 66, 68, 70, and 72. In particular, the user may select the LEDs remain steadily on for a given time period, flash at a given interval, blink in a random pattern, or any other suitable sequence, all of which are within the spirit and scope of the prevent invention as claimed.

Figure 10:
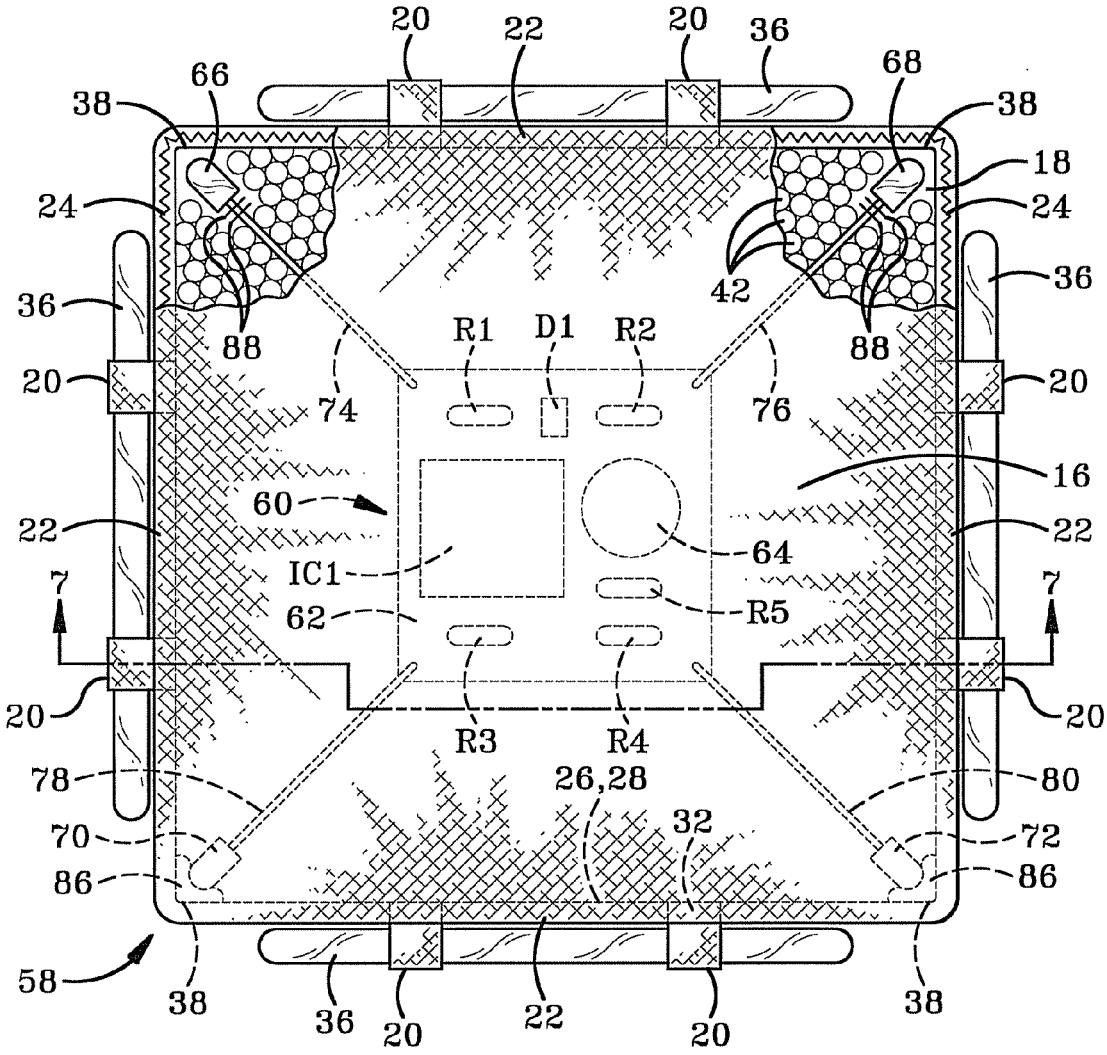
FIG. 10 is a top plan view of a third preferred embodiment gaming bag with the light emitting source stitched within the gaming bag.
Figure 11:
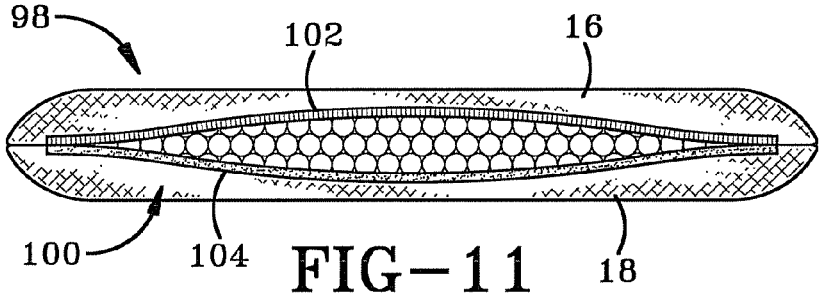
FIG. 11 is a side elevational view of a fourth preferred embodiment gaming bag secured with a hook and loop fastener.

Printed circuit board 62 is preferably arranged within filling material 42 as seen in FIGS. 5 and 7. Light emitting source 60 is illustrated as being free floating within the second embodiment gaming bag 58, however it should be immediately apparent to one of ordinary skill in the art that light emitting source 60 may be secured to either top wall 16 or bottom wall 18 with an adhesive or stitches without departing from the spirit and scope of the invention as claimed. LEDs 66 through 72 are each preferably located proximate side walls 22. Specifically, the LEDs are located proximate corners 38. LEDs 66 through 72 may be secured proximate corners 38 with an adhesive 86. Advantageously, locating the LEDs within the corner ensures that the perimeter of the gaming bag is visible upon impact. In an alternative embodiment, LEDs 66 through 72 are secured within their respective corners 38 with thread 88 as seen in FIG. 10. By incorporating thread to secure the LEDs within their respective corners, the LEDs can be secured to either top wall 16 or bottom wall 18 as desired.

Figure 8:
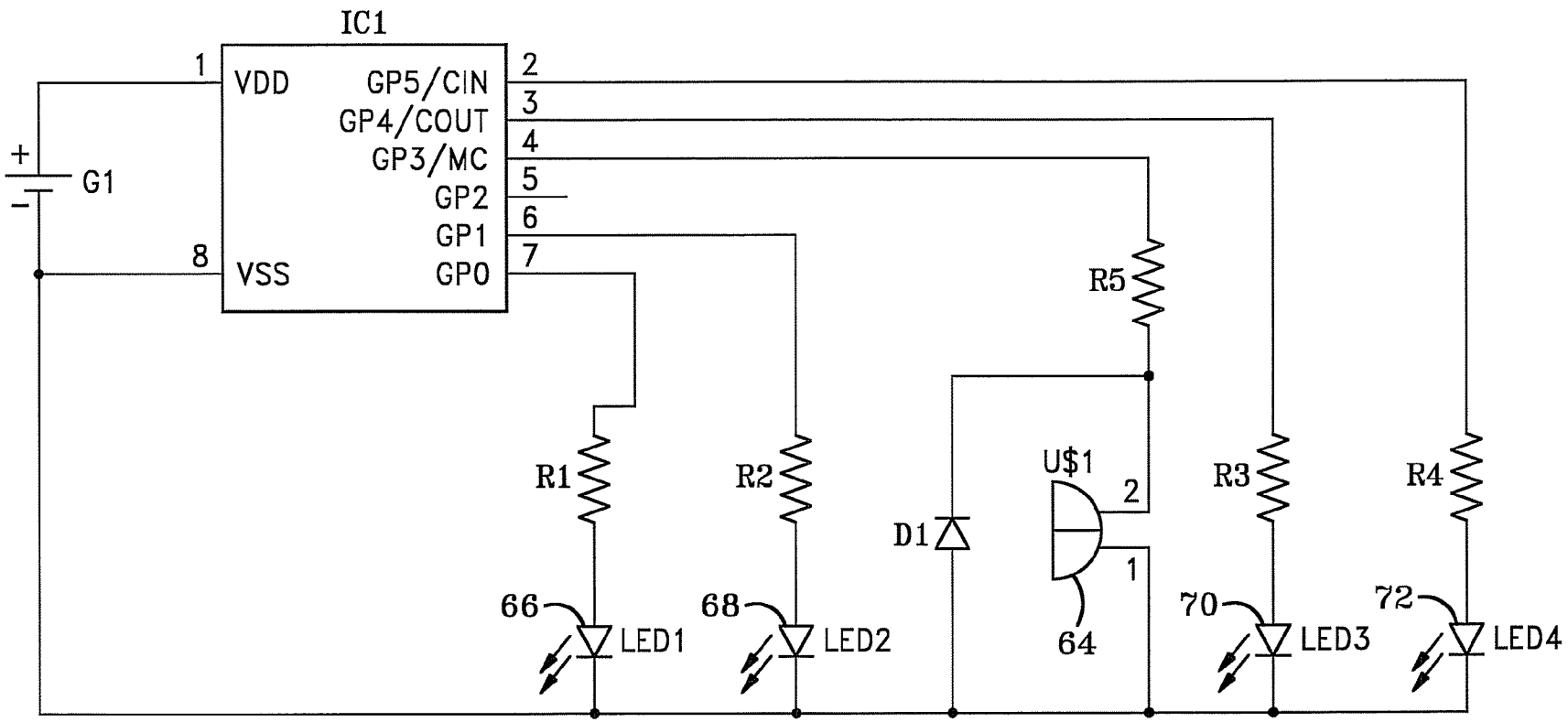
FIG. 8 is an electrical schematic of the light emitting source electrical arrangement.

FIG. 8 is an electrical schematic of the lighted gaming board. Microprocessor IC1 is preferably a model 12F609 manufactured by Micro-Chip Technologies, Inc. Inputs 1 and 8 are the respective positive and negative inputs to the processor, while outputs 2, 3, 6 and 7 connect the processor and the respective LEDs. Resistors R1, R2, R3 and R4 are used to regulate the amount of voltage at the respective LEDs. A diode D1 acts as a voltage clamp and protects the microprocessor from voltage spikes from the sensor through input 5. Sensor 64 is preferably a wide range pizo shock sensor manufactured by Measurement Specialists, model number LDTC028K. In an alternative embodiment, sensor 64 may also be a motion sensor. To further protect the processor and the battery, the processor and battery may be contained within a potted cube to provide resistance to shock and vibration.

Having described the structure of the second embodiment, a preferred method of operation will be described in greater detail and should be read in light of FIGS. 5-9.

Figure 9:
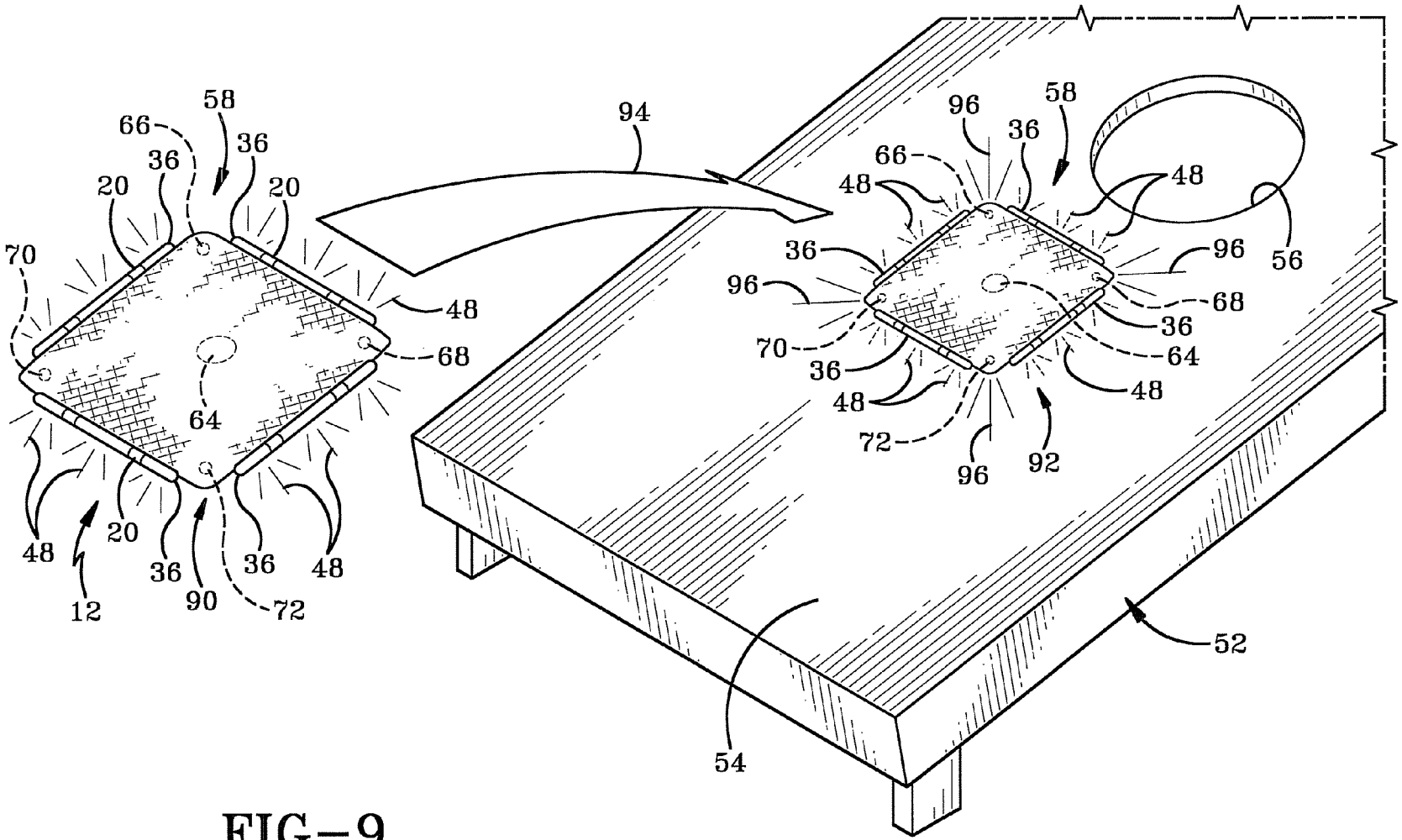
FIG. 9 is a perspective view of the second preferred embodiment gaming bag being thrown and landing on the cornhole board.

Second embodiment gaming bag 58 is shown in both a first state 90 and a second state 92 in FIG. 9. Second embodiment gaming bag 58 is initially in first state 90 whereby glow sticks 36 have already been snapped to provide illumination 48, but LEDs 66, 68, 70 and 72 are not illuminated. The user then throws the gaming bag in the direction associated with arrow 94 towards gaming board 52. When second embodiment gaming bag 58 contacts top surface 54, sensor 64 receives an input of the magnitude of the impact force. Next, sensor 64 transfers the impact force magnitude to processor IC1, where a determination is made if the impact force is greater than the required threshold. If the impact force measured is greater than the threshold force, processor IC1 transmits voltage from battery 82 through resistors R1 through R4 to illuminate LEDs as indicated by lines 96. If the impact face measured is insufficient, then the LEDs remain unlit. The processor may then control whether the LEDs remain illuminated for a predetermined period of time or if the LEDs are programmed to illuminate in an alternating pattern. Finally, processor IC1 may deactivate LEDs 66 through 72 after the predetermined time has elapsed. In an alternative embodiment, the processor may continue to provide voltage to the LEDs until a second shock is measured at the shock center thereby triggering the processor to deactivate the LEDs. In this alternative arrangement, the LEDs would be activated and deactivated based on alternating impact forces. In another alternative embodiment, the LEDs may be activated by the motion sensor in a first pattern when the player throws the gaming bag. Further, the LEDs may be also be activated in a second pattern different that the first pattern when the gaming bag contacts the gaming board.

Having described the structure and operation of two preferred embodiments, only those portions of the third embodiment which are different from the first and second embodiment, are described in greater detail.

A third embodiment lighted gaming bag 98 includes a releasably sealed side wall 100. Top wall 18 preferably includes a hook portion 102, while bottom wall 18 includes a loop portion 104. In this arrangement, hook portion 102 and loop portion 104 are releasably sealable to maintain light emitting source 60 and filler material 42 within gaming bag 98, while still permitting access and replacement of battery 82 (not shown). Although the third embodiment is shown and described without mounting loops or glow sticks, it is within the spirit and scope of the present invention as claimed to include glow sticks on releasable side wall 100 by either securing the mounting loops to top tall 16 or bottom wall 18.

Thus, the lighted gaming bag provides both a constant source of illumination around the perimeter of the gaming bag and internal illumination selectively activated and deactivated to enhance the player's experience. Light emitting source 60 may be secured within the gaming bag in a variety of ways, and includes a sensor and a processor to control the operation of the LEDs.

Accordingly, the lighted gaming bag is an effective, safe, inexpensive, and efficient device that achieves all the enumerated objectives of the invention, provides for eliminating difficulties encountered with prior art devices, systems, and methods, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example and the scope of the invention is not limited to the exact details shown or described.

Having now described the features, discoveries, and principles of the invention, the manner in which the lighted game bag is constructed and used, the characteristics of the construction, and the advantageous new and useful results obtained; the new and useful structures, devices, elements, arrangements, parts, and combinations are set forth in the appended claims.

What is claimed is:

1. A gaming bag comprising:

at least one outer wall defining a cavity;

at least one light emitting source maintained adjacent the at least one outer wall;

a filling material sealed within the cavity; and, wherein the at least one light emitting source provides illumination; and wherein the light emitting source is secured proximate a perimeter of the at least one outer wall and the bag further comprises at least one mounting loop extending away from the at least one wall and the light emitting source is secured to the perimeter by the at least one mounting loop.

2. The gaming bag of claim 1, further comprising a sensor wherein the sensor activates the light emitting source.

3. The gaming bag of claim 2 wherein the sensor is a shock sensor and the light emitting source is activated by the shock sensor receiving greater than a threshold impact force.

4. The gaming bag of claim 3 wherein the light emitting source is activated for a predetermined period of time after receiving greater than the threshold impact force.

5. The gaming bag of claim 1, further comprising a control panel wherein the control panel operates the at least one light emitting source.

6. The gaming bag of claim 5 wherein the control panel and the at least one light emitting source are disposed within the cavity.

7. The gaming bag of claim 1, wherein the at least one outer wall defines a corner and the light emitting source is secured within the corner.

8. The gaming bag of claim 1, wherein the light emitting source is at least one light-emitting diode.

9. The gaming bag of claim 1 wherein the light emitting source comprises at least one glow stick wherein the at least one glow stick is secured within the at least one mounting loop.

10. The gaming bag of claim 9 wherein the glow stick is frictionally engaged within the at least one mounting loop.

11. The gaming bag of claim 9 wherein the bag is generally square in shape and has four sides and the at least one mounting loop is eight mounting loops with two of the mounting loops disposed adjacent each other on each of the sides; and the at least one glow stick is four glow sticks with each glow stick being secured within two adjacent mounting loops.

12. The gaming bag of claim 1, wherein the at least one light emitting source is disposed within the at least one outer wall and the illumination is visible through the at least one outer wall.

13. The gaming bag of claim 1, further comprising a battery wherein the battery powers the light emitting source.

14. The gaming bag of claim 13 wherein the at least one wall is releasably sealed to facilitate replacement of the battery.

15. A gaming bag comprising:

at least one outer wall defining a cavity;

at least one light emitting source maintained adjacent the at least one outer wall, wherein the at least one light emitting source provides illumination;

a filling material sealed within the cavity;

a control panel wherein the control panel operates the at least one light emitting source; wherein the control panel and the at least one light emitting source are disposed within the cavity; and wherein the at least one light emitting source is free floating within the cavity but is maintained adjacent the outer wall of the bag; wherein the gaming bag is substantially square in shape and has four corners, and wherein the at least one light emitting source is four light emitting sources and each of the light emitting sources is maintained in one of the corners.

16. A gaming bag comprising:

at least one outer wall defining a cavity;

at least one light emitting source maintained adjacent the at least one outer wall:

a filling material sealed within the cavity; and wherein the at least one light emitting source provides illumination; and wherein the light emitting source is secured proximate a perimeter of the at least one outer wall; and the at least one outer wall defines a corner and the light emitting sources is secured within the corner;

wherein the gaming bag is substantially square in shape and has four corners; and wherein the at least one light emitting source is four light emitting sources and each of the light emitting sources is located in one of the corners of the square gaming bag.

17. The gaming bag as defined in claim 16, wherein the at least one light emitting source is secured to the corner by one of stitches or adhesive.

* * * * *